US005853055A

United States Patent [19]

Siracki et al.

[11] Patent Number: 5,853,055

[45] Date of Patent: Dec. 29, 1998

[54] ROCK BIT WITH AN EXTENDED CENTER JET

[75] Inventors: Michael A. Siracki, The Woodlands; Per I. Nese, Houston; Alan W. Lockstedt, Tomball; Dennis Cisneros, Kingwood, all of Tex.; Michael S. Oliver, Lafayette, La.; Gary R. Portwood, Kingwood, Tex.

[73] Assignee: Smith International, Inc., Houston, Tex.

[21] Appl. No.: 671,517

[22] Filed: Jun. 27, 1996

[51] Int. Cl.[6] ..... F21B 10/18

[52] U.S. Cl. ..... 175/340; 175/341; 175/424

[58] Field of Search ..... 175/339, 340, 175/424, 341

[56] References Cited

U.S. PATENT DOCUMENTS

| | | | |
|---|---|---|---|
| 1,995,389 | 3/1935 | Howard et al. | 175/340 X |
| 2,901,223 | 8/1959 | Scott | 255/302 |
| 3,823,789 | 7/1974 | Garner | 175/340 |
| 4,067,406 | 1/1978 | Garner et al. | 175/341 |
| 4,106,577 | 8/1978 | Summers | 175/340 |
| 4,531,592 | 7/1985 | Hayatdavoudi | 175/67 |
| 4,546,837 | 10/1985 | Childers et al. | 175/340 |
| 4,558,754 | 12/1985 | Childers et al. | 175/340 |
| 4,611,673 | 9/1986 | Childers et al. | 175/340 |
| 4,657,093 | 4/1987 | Schumacher | 175/353 |
| 4,687,067 | 8/1987 | Smith et al. | 175/340 |
| 4,741,406 | 5/1988 | Deane et al. | 175/340 |
| 4,848,476 | 7/1989 | Deane et al. | 175/340 |
| 4,984,643 | 1/1991 | Isbell et al. | 175/341 |
| 5,072,796 | 12/1991 | Shen et al. | 175/340 |
| 5,394,952 | 3/1995 | Johns et al. | 175/332 |
| 5,494,122 | 2/1996 | Larsen et al. | 175/340 |
| 5,535,838 | 7/1996 | Koshavan et al. | 175/374 |

FOREIGN PATENT DOCUMENTS

| | | | |
|---|---|---|---|
| 0171899 | 2/1986 | European Pat. Off. . | |
| 6514789 | 5/1966 | Netherlands . | |
| 651789 | 5/1966 | Netherlands | 175/340 |
| 1808965 | 4/1993 | U.S.S.R. | 175/339 |
| 1023419 | 3/1966 | United Kingdom . | |

*Primary Examiner*—David J. Bagnell
*Attorney, Agent, or Firm*—Christie, Parker & Hale, LLP

[57] ABSTRACT

A rotary cone bit for drilling bore holes in earth formations whose body has a thread pin end and a dome end from which extend three legs. A cutter cone is rotatably mounted to each leg and is radially oriented about the bit's central axis. Each cutter cone has a gage row of cutting elements extending from the cone surface nearest the mouth and a nose row extending nearest the cone's apex. A center jet for emitting fluid or mud is located on the dome. The jet has a converging nozzle with an exit orifice which extends below a predefined horizontal plane intersected by the cones or cutting elements. The exit orifice has a constant diameter for a length at least equal to its diameter for reducing the diffusion of the fluid or mud flow emitted. Fluid or mud emitted from the center jet travels substantially uninterrupted within a cylindrical space between the cones which is not invaded by any cutting element. This reduced diffusion substantially uninterrupted fluid flow strikes the bore hole bottom with maximum impact energy for enhanced removal of earth formation cuttings.

62 Claims, 9 Drawing Sheets

111
107
110
112

ROCK BIT WITH AN EXTENDED CENTER JET

BACKGROUND OF THE INVENTION

This invention relates to rotary cone rock bits of the type that operate in a "drilling mud." More specifically, the invention relates to rotary cone rock bits that have a center mud jet so configured to enhance bore hole bottom cleaning.

Rotary cone rock bits are used for drilling bore holes in various earth formations. To aid in the removal of drilling cuttings from the bottom of the bore hole, mud or other fluids are introduced to the bottom of the bore hole through jet assemblies on the bit body. The fluid or mud also tends to provide a cooling effect to the rock bits. As the efficiency of the cutting removal is increased so is the cutting efficiency of the bit.

To be efficiently removed from the bore hole, the fluid or mud must carry the cuttings radially outward on the bore hole bottom and then upward through the annulus (i.e., the annular space formed between the bit body and drill string, and the bore hole). A fluid flow that will carry the cuttings radially outward from the center of the bore hole and up the annulus may be created by introducing a downward fluid flow on the center of the bore hole. The fluid impacts the bore hole bottom and spreads radially outward toward the annulus. As the impact energy of the fluid striking the bottom of the bore hole increases so does the shear velocity of the fluid radially across the bore hole bottom, resulting in reduced "chip hold down" and better cutting removal. In addition, the increase in shear velocity creates a radially outward momentum in the flow of the fluid or mud, enhancing cutting removal. "Chip hold down" is a term referring to a rock fragment being held in its crater due to a positive pressure differential on top of it. The higher pressure differential is caused by mud weight or flow in the bore hole creating a higher fluid pressure above the chip then the fluid pressure under the chip.

To facilitate cutting removal, some bits utilize multiple jets. These bits typically have the multiple jets oriented proximate their periphery and sometimes aligned such that the jet of fluid will strike the bit cutter cones and cutting elements. These type of jets tend to oppose the efficient flow of the cuttings, i.e., they tend to force the cuttings back towards the center of the bore hole and up through the center of the bit, reducing the cutting removal rate and reducing the bit drilling efficiency.

Some of these bits may also incorporate a center jet, which is typically located in the center of the bit in the dome. The central axis of the center jet is generally coaxial with the bit central axis, and the center jet nozzle orifice is generally located above the cutting elements of the cutter cones. Typically, the flow through these center jets does not have sufficient energy when it impacts the bottom of the bore. Consequently, the flow from the peripheral jets tends to also oppose and overcome the flow from the center jet, resulting in a flow that opposes the efficient removal of the cuttings especially from the bottom center of the bit. This opposing flow results in a chaotic flow pattern at the bottom, resulting in a decreased bit cutting efficiency.

Some prior art bits do not incorporate jet nozzles but have openings or ports through the dome at or near the center of the bit.

Other bit designs utilize a center jet which has multiple orifices or nozzles directed in various directions. Consequently, the fluid is jetted simultaneously in many directions reducing the energy with which the fluid impacts the bottom of the bore. This type of center jet tends to produce a rapidly diffusing fluid flow having a lower impact energy. Consequently, the radially outward momentum of the fluid flow is reduced, resulting in a reduced cutting removal rate.

Other center jets are designed such that their exit orifices are near the bore hole bottom. To prevent clogging of these orifices, a high pressure drop across the jet is required. Generally, a center jet that is placed close to the bore hole bottom is used as a tap drill for cutting a relatively small diameter hole in advance of the bit in hard rock formations. This type of center jet is generally used with small diameter bits, i.e., bits having a diameter smaller than 4 inches. The pressure drop across this type of center jet is very high, typically 15.5 ksi. Even with such high pressure drop, clogging of the nozzle orifices close to the bore hole bottom does occur resulting in the failure of the bit. Furthermore, the high pressure fluid flow and spray of mud through a high pressure nozzle results in the rapid erosion of the cone shells as well as of the nozzle itself.

Moreover, to achieve a high pressure drop across the jet, the rate of fluid or mud jetted must be reduced to typically less than 10 gallons per minute. Such a reduced flow rate, however, tends to be insufficient for proper cutting removal and may cause failure of the bit. For efficient cutting removal and for sustaining current drilling rates (typically in excess of 15 feet per hour) in soft to medium type formations, high flow rates of fluid through the rock bit's jets—on the order of 350 to 1500 gallons per minute for 7⅞ inch to 17½ inch diameter bits—are required (typically, 1 to 4 ksi pressure drop across the nozzles), otherwise the cuttings cannot be displaced from the bore hole bottom efficiently and drilling rates reduce drastically.

Also, some current bits that utilize a center jet do not have intermeshing between cutting elements of adjacent cutter cones. When cutting softer formations, the cuttings may cake between the cutting elements and cause balling. Balling decreases the cutting efficiency of the bit. Intermeshing between the teeth helps dislodge the balling.

In addition, some center jets currently used are aligned so that the fluid flow strikes the cutter cones and cutting elements. This leads to detrimental erosion of the cones and cutting elements as well as reduction in the fluid impact energy as the mud strikes the bottom of the bore hole. The erosion is more severe as the pressure of the fluid flow striking the cones and cutting elements is increased.

Accordingly, there is a need for bits, having cutting elements that either intermesh or do not intermesh, having a center jet that can provide fluid flow to the bottom of the bore hole with minimum diffusion and maximum impact energy. Moreover, to reduce the erosion of the cutter cones and the cutting elements and to also increase the impact energy of the fluid or mud striking the bottom of the bore hole, there is a need for a jet system that will provide fluid flow sufficient for cutting removal without directly striking the cutter cones and cutting elements.

SUMMARY OF THE INVENTION

A rotary cone rock bit comprising a center jet for introducing drilling mud or other fluids into the bore hole to aid in the removal of cuttings. In the preferred embodiment, as the bit rotates a cylindrical space is defined between the cutter cones which is not invaded by the cutting elements of the cutter cones. This space is coaxial with the central axis of the bit and provides a path for uninterrupted fluid flow from the center jet to the bore hole bottom. The cutting elements of the cutter cones may or may not intermesh. Intermeshing is preferred, however, when drilling softer earth formations, to reduce balling. In an alternate embodiment, a significant cylindrical space is not formed between the cones.

The fluid flow from the jet is substantially parallel or coaxial with the bit cental axis. To ensure that the fluid flow strikes the bottom of the bore hole with maximum impact energy, a converging nozzle is used, with the jet, designed to minimize the fluid flow diffusion. Diffusion of fluid flow exiting a nozzle is minimized by utilizing a converging nozzle that has an orifice having a constant diameter for a length at least equal to such diameter. For maximum impact energy, at least a portion, and preferably a substantial portion, of the fluid flow travels within the cylindrical space so as to be uninterrupted until it strikes the bottom of the bore hole, and the nozzle exit is positioned closer to the bottom of the bore hole.

In an embodiment which does not comprise a significant cylindrical uninvaded space, the nozzle exit must be positioned as close as possible to the bottom of the bore hole, at least below the highest inner root of a gage row cutting element, so as to maximize the impact energy of the fluid striking the bottom of the hole. Since, there is no significant cylindrical uninvaded space, the location of the nozzle exit is limited by the location of the cutter cones.

In a preferred embodiment, the diameter of the cylindrical space is greater than 0.3 inch (7.6 mm). In an alternate embodiment, the nose row of cutting elements on the cutter cone is at a distance away from the bit's central axis equal to at least 5% of the bit gage diameter. The fluid flow axis, should preferably be directed at a location at the bottom of the bore hole which is within one third of the bore hole radius from the center of the bore hole.

Additional jets may be used in combination with its center jet. However, at least 20% of the fluid flow should occur through the center jet so as to maintain a positive fluid or mud flow radially outward from the center of the bore hole bottom and up through the annulus. It is recommended however, that at least 40%, preferably 75%, of the fluid flow occurs through the center jet.

The nozzle of the center jet is designed for easy removal to facilitate its replacement. Due to its exposure to fluid flow and to a spray of mud and cuttings, the nozzle is made from an erosion resistant material. The nozzle can also be coated with a coating or covered with a shroud made from enhanced erosion resistant materials.

To reduce erosion wear of the cone and cutting elements proximate the fluid flow, the nose portion of the cones may be offset away from the bit's centerline so as to distance the cutting elements and the nose portion of the cutter cones from the fluid flow path.

DETAILED DESCRIPTION

Figure 1:
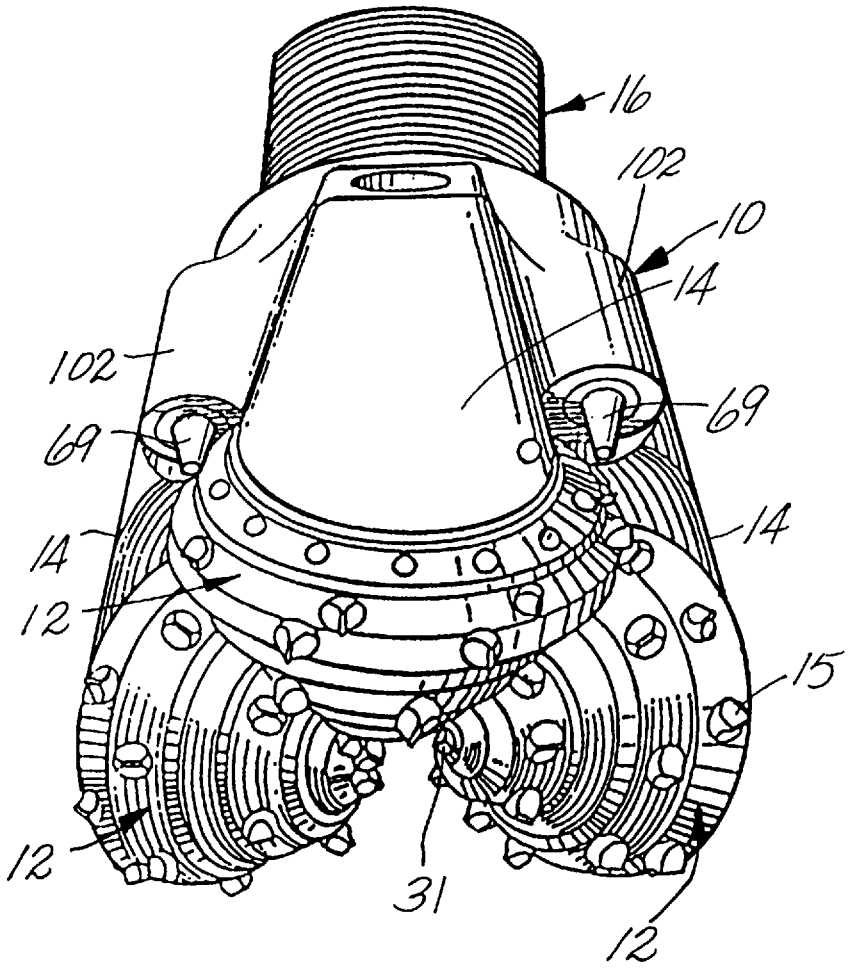
FIG. 1 is a side view of a rotary cone rock bit having three cones.

A typical rock bit 10, as shown in FIG. 1, comprises a steel bit body and three cutter cones 12 mounted on legs 14 extending from the bottom of the body. The upper end 16 of the body is threaded and serves as the pin for assembly of the rock bit onto a drill string for drilling bore holes, oil wells or the like. The area between the legs on the underside of the body is referred to as the dome 18 (see FIG. 2).

Figure 2:
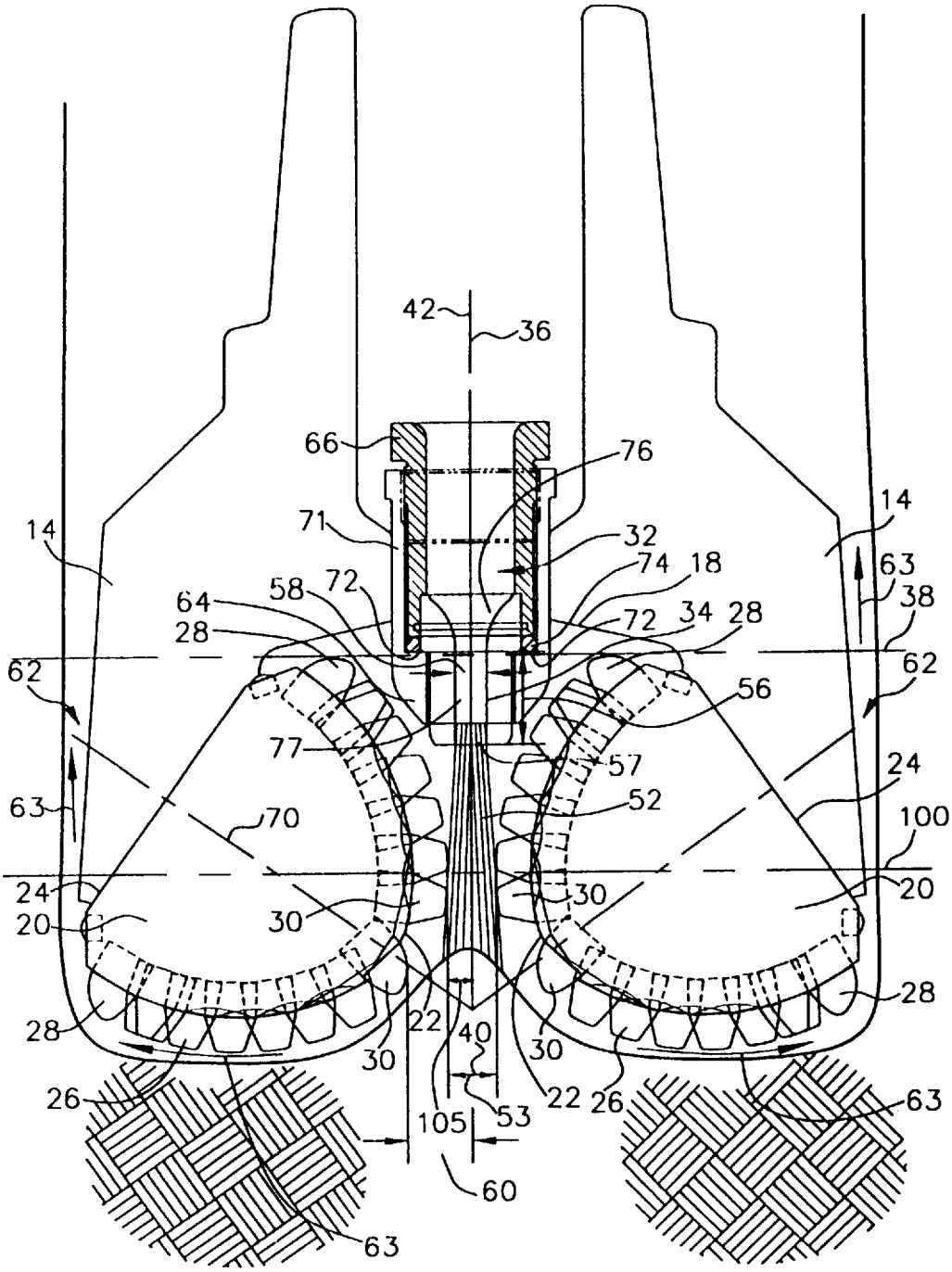
FIG. 2 is a semi-schematic longitudinal cross-sectional view of a rotary cone rock bit having a center jet with an extended nozzle and also shows the fluid or mud flow through a cylindrical uninvaded space for enhanced cutting removal. The three cutter cones are depicted superimposed upon one another and then mirrored about the bit central axis 36.

A layout of a three cone rock bit per a preferred mode of the present invention is shown in FIG. 2 with the three cutter cones superimposed upon one another and then mirrored about the bit central axis 36. The internal structure for mounting the cutter cones on the legs is omitted since it is conventional and forms no part of this invention.

A cutter cone is rotatably mounted on each of the legs. Each cutter cone has a hollow, generally conical steel body 20. The cones have an apex or nose 22 on one end and a mouth 24 on the other. Each leg has a bearing journal (not shown) extending from its end. Each cone is fitted over the journal, i.e., the journal is positioned inside the cone through the cone's mouth. Ball bearings (not shown) retain the cones on the journals. When mounted on the journals, the cones are radially oriented about the bit central axis so that the nose of the cones is closer to the axis than the mouths of the cones.

Figure 7:
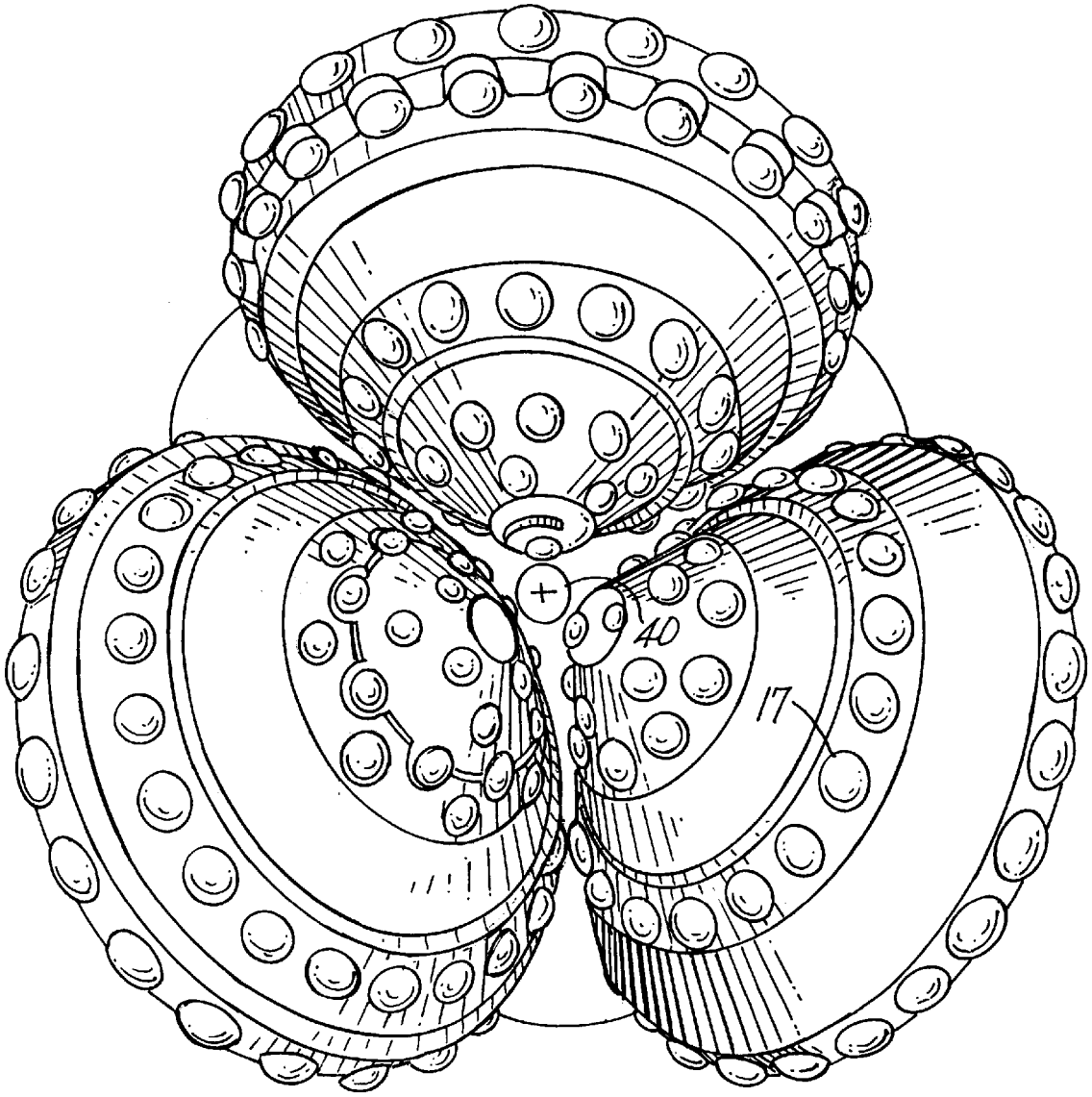
FIG. 7 is a bottom view of a semi-round insert-type rotary cone bit having an uninvaded cylindrical space 40.

Tungsten carbide inserts 26 (also referred to herein as the "cutting elements") are pressed into holes on the external surface of the cones. The tungsten carbide inserts provide the drilling action by engaging subterranean rock formation as the rock bit is rotated. The inserts may be of the chisel type 15 shown in FIG. 1 or may be of the semi-round type 17 as shown in FIG. 7. For longer life, the inserts may be tipped with a polycrystalline diamond layer. Some types of bits have hard faced steel teeth milled on the outside of the cone, instead of carbide inserts. These bits are generally referred to as milled-tooth bits.

Rock bits with cemented tungsten carbide inserts, or other suitable hard metal inserts, are typically used for drilling soft to hard material, whereas, milled-tooth bits are typically used for drilling softer formations. Although the present invention is equally applicable to both types of bits, for descriptive purposes, reference is made herein only to the carbide insert rock bits.

The cutting elements are typically arranged in annular rows on the cone. The row furthest away from the apex or nose of the cone is referred to as the gage row 28. The row closest to the apex of the cone is referred to as the nose row 30. For cones comprising a single central cutting element 31 on their apex, the nose row is the central cutting element 31.

The drawing of FIG. 2 is also schematic in its illustration of the inserts. The inserts are illustrated on each cone in apparently overlapping positions. These inserts represent the inserts on all three of the cones projected around to the planes illustrated. This is done for illustrating the complete coverage of the bore hole bottom by inserts during a complete revolution of the bit. In actuality, about ⅓ of the insert rows are on each cutter cone and the insert rows are arranged on the individual cones so that they do not interfere with rows of inserts on the adjacent cones.

A center jet assembly 32 is located substantially at the center of the bit body dome 18. An outer steel sleeve 71 is welded into the dome of the bit body. The center jet assembly has a cemented tungsten carbide nozzle 34 with a shoulder that seats on a shoulder 72 in the steel sleeve. An inner retainer sleeve 66 is threaded into the outer sleeve for securing the center jet against the shoulder. An O-ring 74 seals between the outer sleeve and the center jet body to prevent washout around the jet body. For brevity, "jet" as used herein refers to the jet assembly.

The nozzle 34 is substantially parallel to the bit centerline 36. The nozzle in the center jet has a smoothly converging portion 76 at its upstream end blending into a cylindrical orifice portion 77 which helps streamline flow through the nozzle and direct a streamlined flow toward the bottom of the bore hole. The jet with nozzle is used to introduce drilling mud or other fluids into the bore hole to aid in the removal of cuttings. The fluid or mud flow through and from the jet is commonly referred to herein as the "fluid flow." The nozzle orifice exit 57 is extended below the highest horizontal plane 38 intersected by any part of the cones. Generally, this highest plane is the plane intersected by the gage rows of inserts. In an alternate embodiment, the nozzle is embedded within the dome and the dome is extended such that the nozzle exit is located below this highest plane.

By positioning the exit of the nozzle closer to the bore hole bottom, the impact energy of the fluid flow striking the bottom of the bore hole is increased. However, placing the nozzle exit adjacent to the bottom of the bore hole may cause clogging of the orifice or pressure spikes due to the center portion of the bore hole bottom building up, thus, causing flow restriction. Clogging or flow restriction through the jet results in failure of the bit. Generally, therefore, it may be prudent for the location of the nozzle exit not to be below the highest horizontal plane 100 intersected by a nose row cutting element.

Preferably, the lower end of the center jet extends to a plane below a plane intersected by any portion of the gage rows of cutting elements on the cutter cones. The lower end of the center jet is preferably placed as far down as possible while still leaving sufficient clearance between the jet and cutting elements to prevent breakage of either component and/or prevent the cutter cones from locking up.

Figure 8:
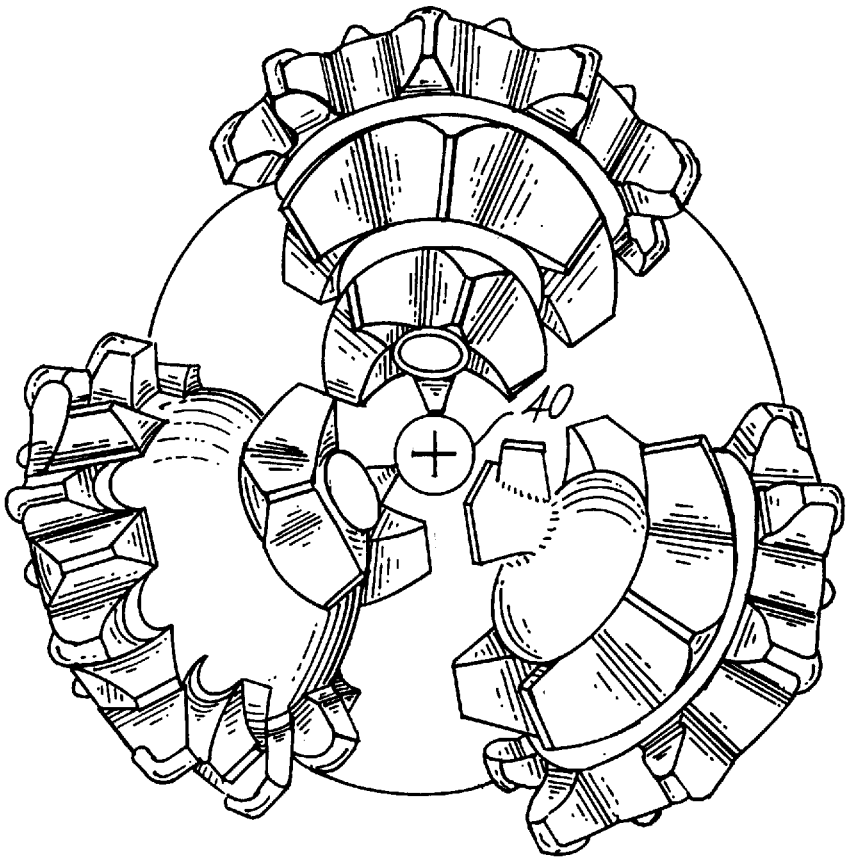
FIG. 8 is a bottom view of a milled-tooth rotary cone bit having an uninvaded cylindrical space 40.

In the preferred embodiment, as the bit rotates, a cylindrical space 40 is defined between the cones which is not invaded by the cutting elements or cones, as shown in FIGS. 7 and 8 for an insert type and a milled-tooth bit, respectively. This cylindrical space has a central axis 42 coaxial with the central axis 36 of the bit. Therefore, the radius 105 of the cylindrical space 40 is equal to the distance of the closest cutting element on a cutter cone, as the cutter cones rotate about their own axis 70, to the bit central axis 42. The cylindrical space provides a path for uninterrupted fluid flow from the center jet nozzle to the bore hole bottom.

Figure 5:
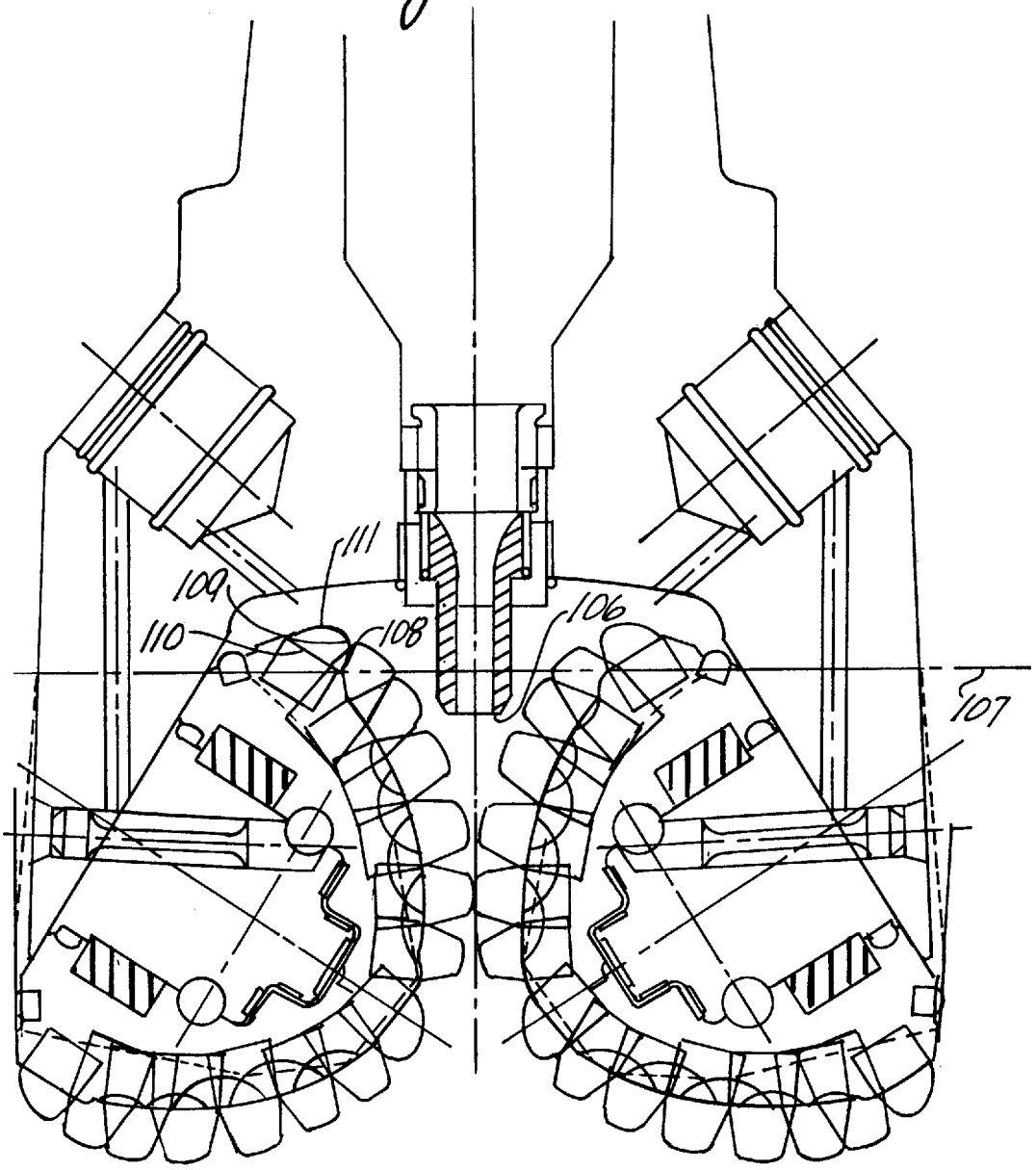
FIG. 5 is a semi-schematic longitudinal cross-sectional view of a rotary cone insert type rock bit without a significant uninvaded space formed between the cones, the bit having a center jet with an extended nozzle. The three cutter cones are depicted superimposed upon one another and then mirrored about the bit central axis 36. A horizontal plane 107 is shown intersecting the inner roots of gage row cutting elements.
Figure 6:
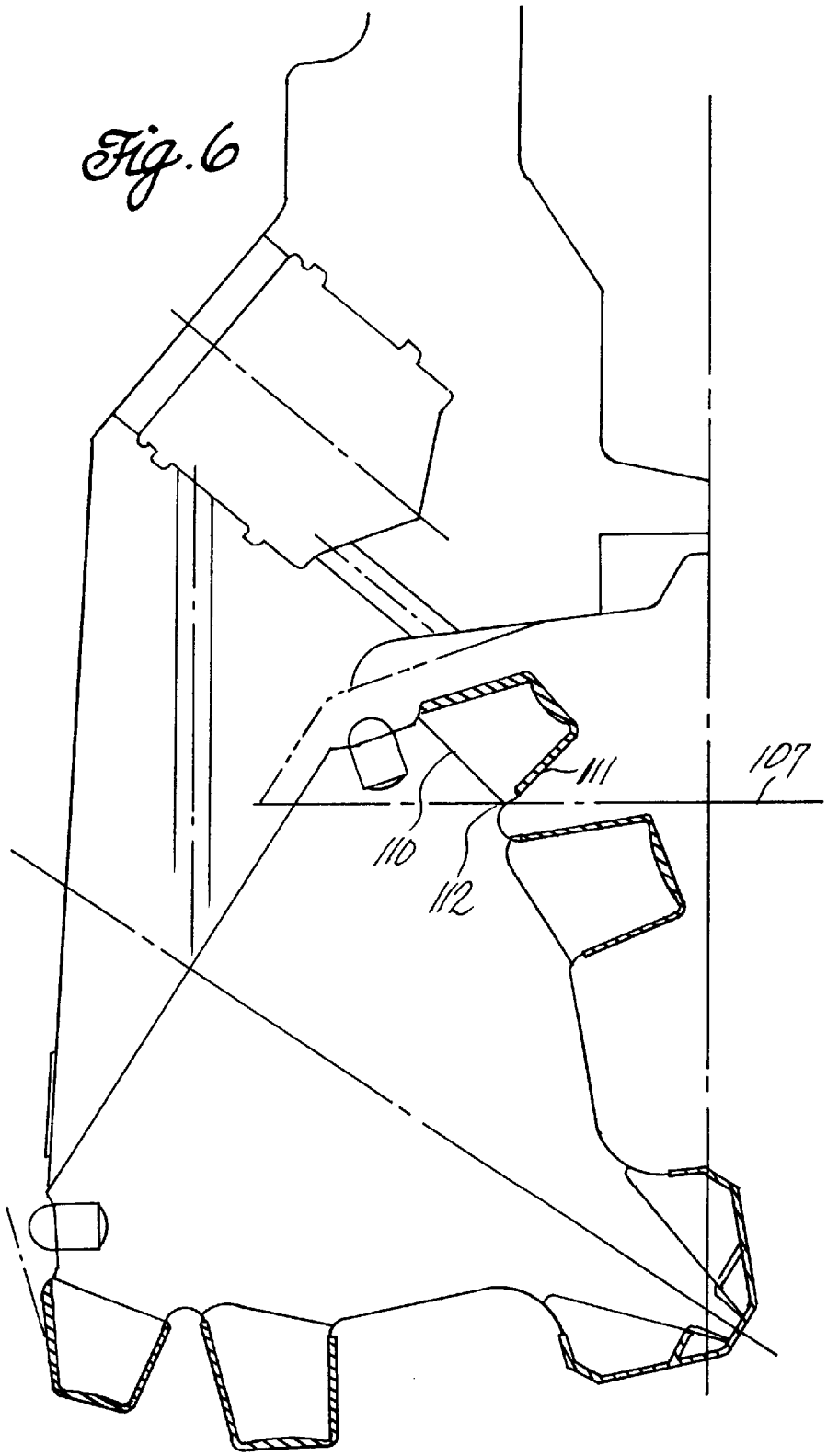
FIG. 6 is a semi-schematic longitudinal cross-sectional view of a single leg and cone of a milled-tooth rotary cone bit showing the intersection of a horizontal plane and the inner roots of gage row cutting elements.

In an alternate embodiment shown in FIG. 5, a significant cylindrical uninvaded space is not formed between the cones. With this embodiment, either an uninvaded space is not formed, or a minimal uninvaded space is formed. Since the fluid flow in this embodiment will be substantially interrupted, the nozzle exit 57 should be at least below a horizontal plane 107 through the highest inner root 108 of a gage row cutting element 111 to overcome the energy losses attributed to the cutting elements intruding on the fluid flow from the center jet. The inner root of a cutting element is the lowest point of the intersection between the inner side 109 of the cutting element 111 and the cutter cone surface 110. FIG. 6 shows the horizontal plane 107 through the highest inner root 112 of a gage row of a hardfaced milled-tooth bit (note only one cone is shown to simplify the figure). The gage row highest inner root for each cone of a three cone insert type rock bit is generally at the same height, whereas for a milled-tooth type rock bit the location of the inner root will typically vary from cone to cone.

Figure 3:
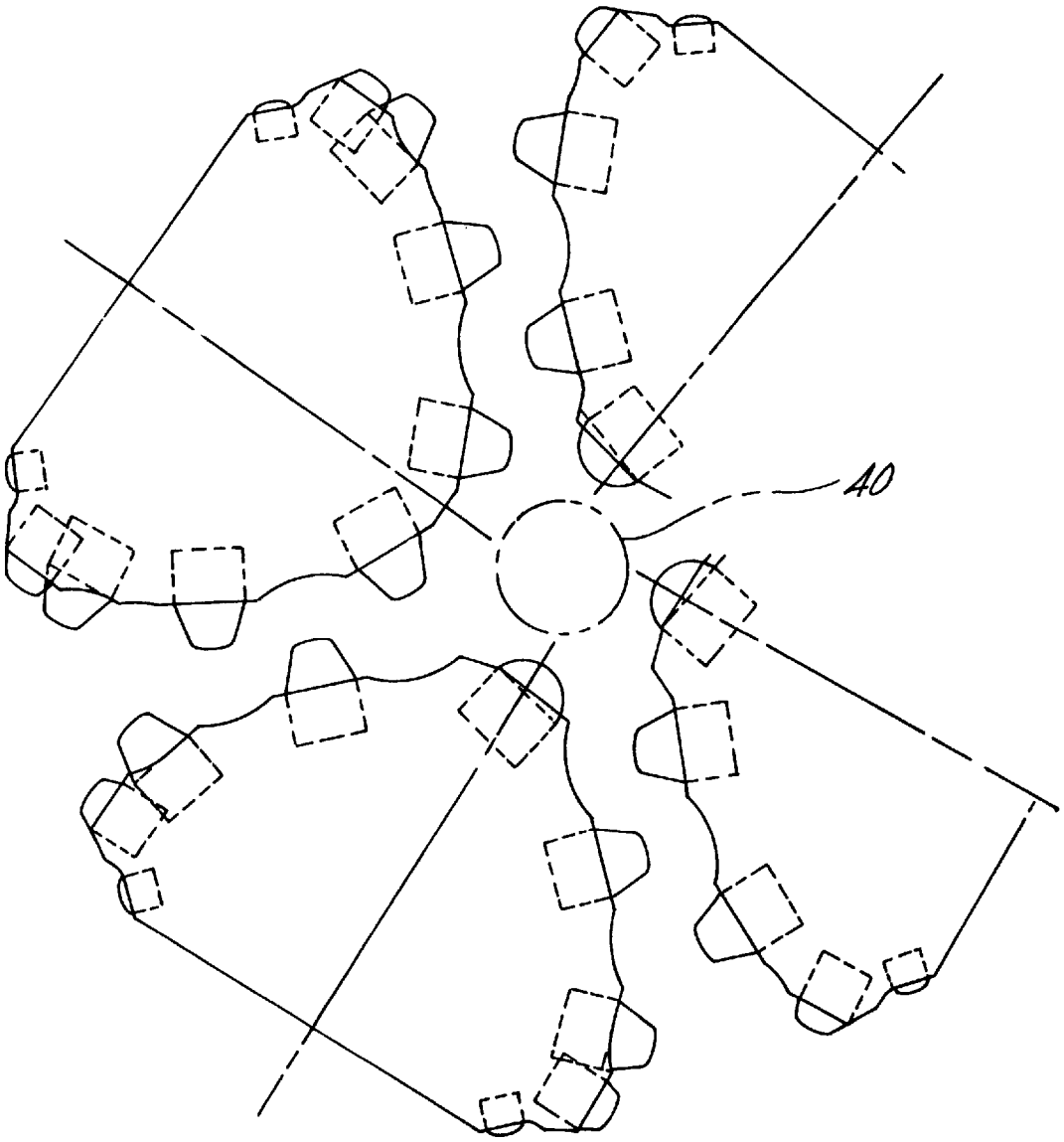
FIG. 3 is a bottom projected view of a three cone spread rock bit. One of the cones has been split for illustrating the spacing between cutting elements of adjacent cones.

A "spread bit," has a cylindrical non-invaded space 40 (FIG. 3). A spread bit has smaller cones with cutting elements which do not intermesh with each other. When drilling softer formations, however, it may be preferable to have intermeshing between the cutting elements as indicated in the circled areas of FIG. 4. With softer formations, the earth cuttings cake between the cutting elements causing what is known as "balling". Balling reduces the cutting efficiency of the bit.

Figure 4:
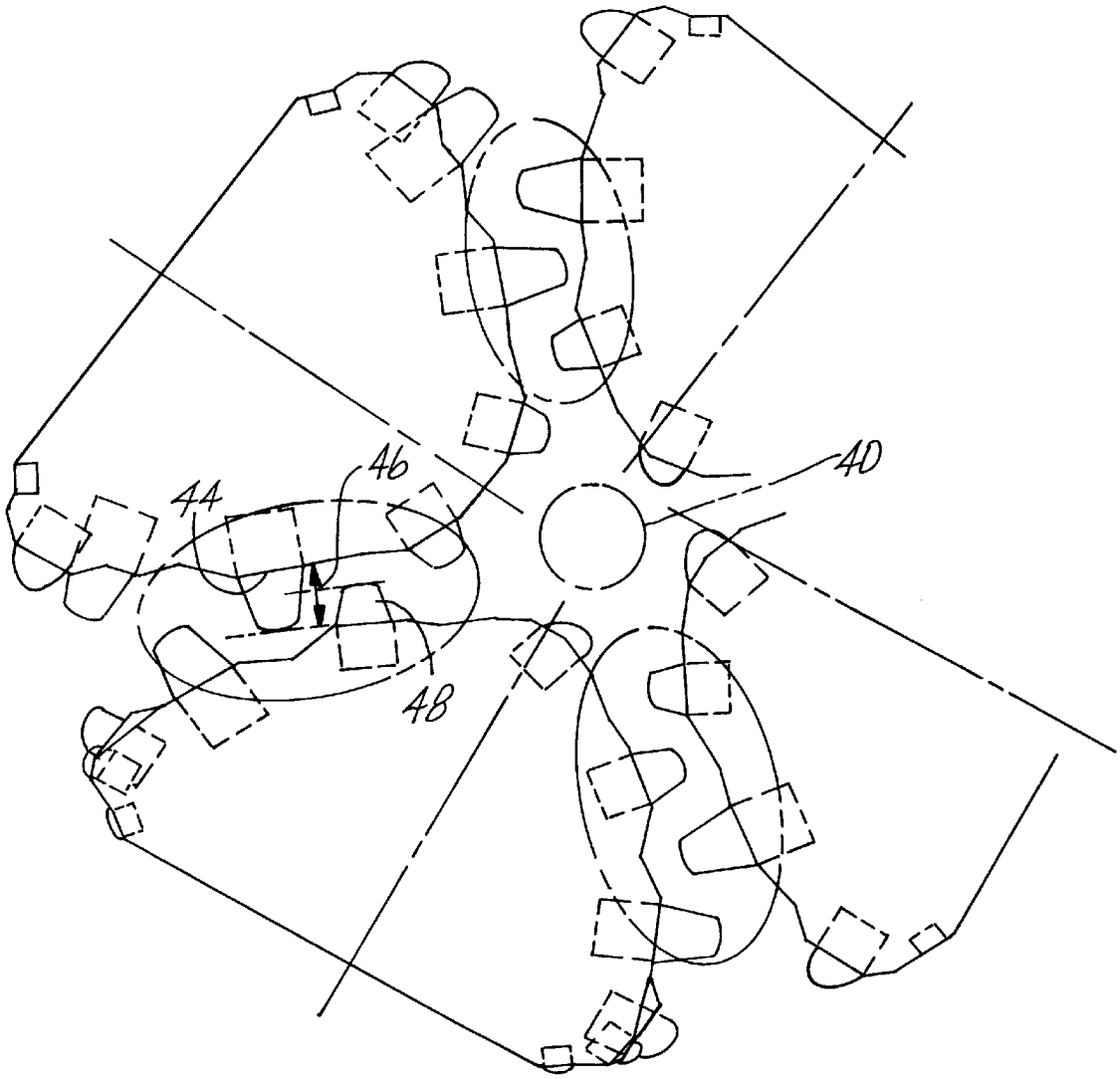
FIG. 4 is a bottom projected view of a three cone rock bit showing intermeshing between cutting elements. One of the cones has been split for illustrating intermeshing between cutting elements of adjacent cones.

Intermeshing reduces balling. As a cutting element of one cone intermeshes between the cutting elements of another cone, it dislodges any balling between the cutting elements. Moreover, having intermesh allows the diameter of the cones to be larger, providing for a larger bearing surface which results in a more durable cone. It is preferable that cutting elements intermesh over 50% of their length. In other words, an intermeshed tooth 44 of one cone is overlapped over 50% of its length 46 by a tooth 48 from an adjacent cone (FIG. 4).

A column 52 of fluid or mud flowing from the nozzle is able to travel within the cylindrical space and reach the bottom of the bore hole substantially uninterrupted (FIG. 2). This fluid flow column tends to increase in diameter with distance from the nozzle exit. The existence of the cylindrical space allows the substantially uninterrupted fluid flow to impact the bottom of the hole with maximum energy and with a velocity profile substantially intact.

To maintain a streamlined flow with minimal diffusion, the center jet has a streamlining nozzle, i.e., a converging nozzle that has an orifice having a constant diameter 58 for a length 56 at least equal to such diameter. It is believed that a ratio of nozzle orifice length to diameter of about two is optimum.

In the preferred embodiment, the fluid or mud flow column is substantially contained within the cylindrical space. In an alternate embodiment, the flow column has a diameter greater than the diameter of the cylindrical space. In such case, only the portion of the flow within the cylindrical space is uninterrupted. The fluid flow column diameter can be controlled by either lowering the nozzle exit or changing the diameter of the nozzle orifice.

The axis of the flow column does not have to be coincident with the central axis of the bit. However, the two axes are preferred to be substantially parallel. Moreover, it preferred that the flow axis is directed to the bore hole bottom within one third of half the bore hole diameter from the bore hole center.

To facilitate removal of rock cuttings from the bore hole, generally high flow rates are required. These rates are typically on the order of 6 to 10 gallons per minute (gpm) for every square inch of the bore hole circular cross sectional area. The flow rate increases as the bit diameter increases and consequently so must the jet nozzle orifice diameter. Therefore, it is necessary to have the uninvaded cylindrical space diameters increase as the bit diameter increases.

In the preferred embodiment, the diameter 53 of the uninvaded cylindrical space 40 is greater than 0.3 inch (7.6 mm). For 8¾ inches (22¼ cm) and smaller bits, a cylindrical space diameter of at least a 0.35 inch (8.9 mm) is desirable, and a diameter of at least 0.4 inch (10.1 mm) is preferred. For bits having a diameter greater than 8¾ inches and up to and including to 12¼ inches (31 cm), a cylindrical space diameter greater than 0.4 inch (10.2 mm) is desirable, and a diameter of at least 0.5 inch (12.7 mm) is preferred. For bits having a diameter greater than 12¼ inches and up to and including 17½ inches (44.5 cm), a cylindrical space diameter greater than 0.5 inch (12.7 mm) is desirable, and a diameter of at least 0.75 inch (19 mm) is preferred. For bits having a diameter greater than 17½ inches, a cylindrical space diameter of 0.6 inch (15.2 mm) is desirable, and a diameter of 1.0 inch (25.4 mm) is preferred.

In an alternate embodiment, the nose row inserts or central inserts of each cone are at a distance 60 away from the bit central axis equal to at least 5% of the bit gage diameter to prevent fluid erosion from removing cone material around the inserts allowing them to become detached from the cutter cone.

Figure 9:
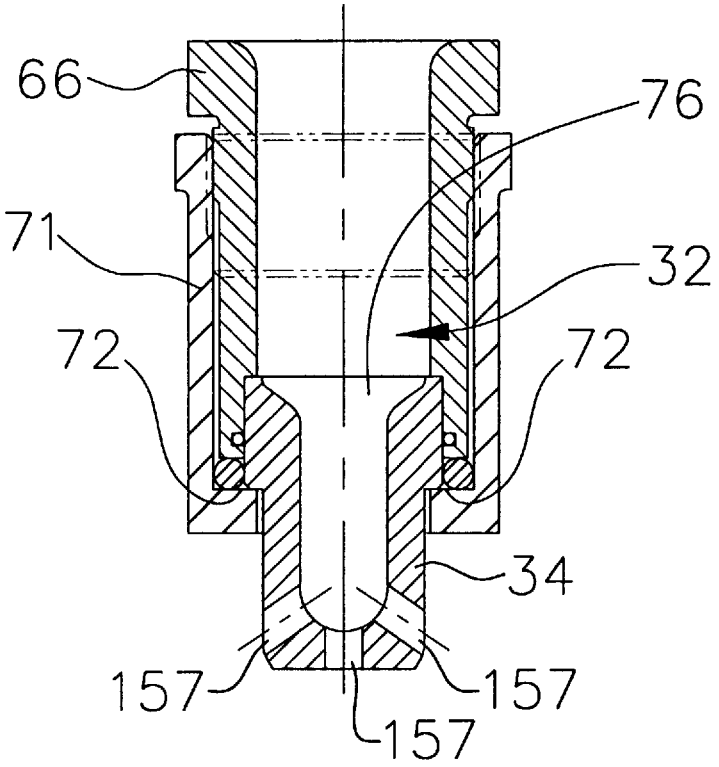
FIG. 9 is a partial cross-sectional view of a center jet having a plurality of exit orifices.

In a further embodiment, the center jet may have a plurality of exit orifices 157 (FIG. 9). In such case, it is preferred that the fluid flow columns emitted from the orifices are directed to bore hole bottom within one third of half the bore hole diameter from the hole center.

Use of a single center jet is preferred since it allows for a streamline bit body design, i.e., removal of one or more outer jet bosses 102 (FIG. 1), which results in a larger annulus 62 and, therefore, easier cutting removal. However, this is not necessary. In a further embodiment, for example, the bits incorporate one or two additional jets 69 (FIG. 1) having nozzles situated close to the periphery of the bit body between the legs. Use of such nozzles is well known in the art. When multiple jets are used at least 20% of the fluid or mud flow should occur through the center jet to help alleviate bit balling and to ensure that the fluid or mud flow carrying the cuttings will flow radially outward from the center of the bore hole and up the annulus to achieve sufficient chip removal from the hole bottom. For better chip removal, however, it is recommended that at least 40%, and preferably 75%, of the fluid flow occur through the center jet. This preferred flow path for the fluid for enhanced removal of cuttings is shown in FIG. 2 by arrows 63.

A tungsten carbide nozzle extending below the dome is subjected to erosion from mud flow through the nozzle as well as circulating or sprayed mud and cuttings within the bore hole and is also subject to breakage. To enhance the erosion resistance of the nozzle, the nozzle may be coated with an erosion resistant material or may be covered with a protective shroud 64 extending from the outer sleeve. The protective shroud may also help prevent nozzle breakage.

The portion of the cone including the cutting elements near or impinged by the fluid flow from the jet are preferably coated to increase their erosion resistance. This erosion, referred to as cone shell erosion, typically occurs in areas near the paths of mud or fluid emitted from the nozzles of the bit or in areas proximate the bore hole surfaces struck by the mud or fluid flow. In the areas near the flow the mud or fluid may strike or may be deflected onto the cones and cutters resulting in their erosion. A typical erosion resistant coating would comprise a conventional hardfacing with tungsten carbide particles or a coating of tungsten carbide. These coatings can be applied via a high velocity implantation method such as the Super D-Gun method. In bits which utilize a single center jet, only the nose portion of the cones may need to be coated. It may, however, be prudent to coat the entire half of the cone which contains the nose portion. To reduce erosion, the cutting elements proximate a fluid flow may also be fabricated of a material with enhanced wear resistance properties.

In bits comprising a center jet, the most cone shell wear is evident adjacent to the nose row and central cutting elements. It is important, therefore, that these cutting elements and surrounding cone areas be protected. Besides coating such areas, it may be beneficial to additionally offset the noses of the cones away from the bit central axis so as to distance the cutting elements on the nose of each cone from the fluid flow path. This can typically be accomplished by moving nose row inserts toward the mouth of the cone 24 parallel to the cone central axis 70.

Although this invention has been described in certain specific embodiments, many additional modifications and variations will be apparent to those skilled in the art. It is therefore, understood that within the scope of the appended claims, this invention may be practiced otherwise than specifically described.

What is claimed is:

1. A rotary cone bit for drilling bore holes in earth formations comprising:

a bit body having a threaded pin end and a dome end;

three legs extending from the dome end of the body;

three cutter cones having an apex opposite a mouth, wherein each cone is rotatably mounted through its mouth to each leg, wherein each cone is radially oriented about a bit body central axis wherein the apex of each cone is closer to the central axis than the cone mouth;

cutting elements extending from the cone outer surface, the cutting elements having an inner root, the inner root being the lowest point on the cutting element intersecting the cone outer surface, the cutting elements comprising, at least one gage row proximate to the mouth, and at least one nose row proximate to the apex;

a first jet for emitting fluid flow; and a center jet located on the body having a nozzle aligned to produce a fluid flow substantially parallel to the bit central axis, wherein the nozzle has an orifice having an exit located below a highest horizontal plane intersected by the inner root of a gage row cutting element, wherein at least 40% of the fluid flow occurs through the center jet.

2. A rotary cone bit as recited in claim 1 wherein the flow is coaxial with the bit axis.

3. A rotary cone bit as recited in claim 1 wherein the cutting elements forming the nose row are located at a radial distance from the bit central axis equal to at least 5% of the bit gage diameter.

4. A rotary cone bit as recited in claim 1 further comprising a jet sleeve secured to the dome, wherein the nozzle is replaceably connected to the sleeve and is located entirely below the dome.

5. A rotary cone bit as recited in claim 1 further comprising a protective shroud covering a portion of the nozzle extending below the dome end.

6. A rotary cone bit as recited in claim 1 wherein at least 75% of the total fluid flow occurs through the center jet.

7. A rotary cone bit as recited in claim 1 wherein at least one cone has its surface near the cone apex proximate the nose row of cutting elements enhanced to increase the surface resistance to fluid erosion.

8. A rotary cone bit for drilling bore holes in earth formations comprising:

a bit body having a threaded pin end and a dome end;

three legs extending from the dome end of the body;

three cutter cones having an apex opposite a mouth, wherein each cone is rotatably mounted through its mouth to each leg, wherein each cone is radially oriented about a bit body central axis wherein the apex of each cone is closer to the central axis than the cone mouth;

cutting elements extending from the cone outer surface, the cutting elements having an inner root, the inner root being the lowest point on the cutting element intersecting the cone outer surface, the cutting elements comprising, at least one gage row proximate to the mouth, and at least one nose row proximate to the apex; and a center jet located on the body having a nozzle aligned to produce a flow substantially parallel to the bit central axis, wherein the nozzle has an orifice having an exit located below a highest horizontal plane intersected by the inner root of a gage row cutting element, wherein the orifice has a constant diameter for a length at least equal to the constant diameter.

9. A rotary cone bit as recited in claim 8 wherein the orifice has a constant diameter for a length at least equal to twice the constant diameter.

10. A rotary cone bit for drilling bore holes in earth formations comprising:

a bit body having a threaded pin end and a dome end;

three legs extending from the dome end of the body;

three cutter cones each having an apex opposite a mouth, wherein each cone is rotatably mounted through its mouth to each leg, wherein each cone is radially oriented about a bit body central axis wherein the apex of each cone is closer to the central axis than the cone mouth;

cutting elements extending from the cone outer surface comprising, at least one gage row proximate to the mouth, and at least one nose row proximate to the apex, the cutting elements being spaced away from the centerline of the bit body a sufficient distance to leave a cylindrical open space between the cutting elements, the cylindrical space having a diameter of at least 0.3 inch;

a first jet for emitting fluid flow; and a center jet having a nozzle having an exit orifice, wherein the nozzle is aligned to produce a fluid flow column having a flow axis substantially parallel to the bit central axis, wherein the nozzle exit is located below a highest horizontal plane intersected by a cutting element, and wherein at least 40% of the fluid flow occurs through the center jet.

11. A rotary cone bit as recited in claim 10 wherein the fluid flow column is substantially contained within the cylindrical space.

12. A rotary cone bit as recited in claim 10 wherein the flow axis is co-axial with the bit central axis.

13. A rotary cone bit as recited in claim 10 further comprising a jet sleeve secured to the dome, wherein the nozzle is replaceably connected to the sleeve and is located entirely below the dome.

14. A rotary cone bit as recited in claim 10 further comprising a protective shroud covering a portion of the nozzle extending below the dome end.

15. A rotary cone bit as recited in claim 10 wherein the cylindrical space diameter is at least 0.35 inch for bits having a diameter up to and including 8¾ inches.

16. A rotary cone bit as recited in claim 15 wherein the cylindrical space diameter is at least 0.4 inch.

17. A rotary cone bit as recited in claim 10 wherein the cylindrical space diameter is at least 0.4 inch for bits having a diameter greater than 8¾ inches and up to and including 12¼ inches.

18. A rotary cone bit as recited in claim 17 wherein the cylindrical space diameter is at least 0.5 inch.

19. A rotary cone bit as recited in claim 10 wherein the cylindrical space diameter is at least 0.5 inch for bits having a diameter greater than 12¼ inches and up to and including 17½ inches.

20. A rotary cone bit as recited in claim 19 wherein the cylindrical space diameter is at least 0.75 inch.

21. A rotary cone bit as recited in claim 10 wherein the cylindrical space diameter is at least 0.6 inch for bits having a diameter greater than 17½ inches.

22. A rotary cone bit as recited in claim 21 wherein the cylindrical space diameter is at least 1 inch.

23. A rotary cone bit as recited in claim 10 wherein the cutting elements forming the nose row are located at a radial distance from the bit central axis equal to at least 5% of the bit gage diameter.

24. A rotary cone bit as recited in claim 10 further comprising at least one more jet having a nozzle located between adjacent legs proximate a peripheral surface of the bit.

25. A rotary cone bit as recited in claim 10 wherein at least 75% of the total flow is through the center jet.

26. A rotary cone bit as recited in claim 10 wherein the fluid flow column axis is directed to a location at the bottom of the bore hole within one third of half of the bore hole diameter from the center of the bore hole.

27. A rotary cone bit as recited in claim 10 wherein at least one cone has its surface near the cone apex proximate the nose row of cutting elements enhanced to increase the surface resistance to fluid erosion.

28. A rotary cone bit as recited in claim 10 wherein at least one cutting element has at least half of its length beyond the cone intermeshed with a cutting element from an adjacent cone.

29. A rotary cone bit as recited in claim 10 wherein the nozzle has a constant diameter for at least a length equal to the constant diameter.

30. A rotary cone bit as recited in claim 10 wherein the nozzle has a constant diameter for at least a length equal to twice the constant diameter.

31. A rotary cone bit for drilling bore holes in earth formations comprising:

a bit body having a threaded pin end and a dome end;

three legs extending from the dome end of the body;

three cutter cones each having an apex opposite a mouth, wherein each cone is rotatably mounted through its mouth to each leg, wherein each cone is radially oriented about a bit body central axis wherein the apex of each cone is closer to the central axis than the cone mouth;

cutting elements extending from the cone outer surface comprising, at least one gage row proximate to the mouth, and at least one nose row proximate to the apex, the cutting elements being spaced away from the centerline of the bit body a sufficient distance to leave a cylindrical open space between the cutting elements, the cylindrical space having a diameter of at least 0.3 inch; and a center jet having a converging nozzle having an exit orifice, wherein the nozzle is aligned to produce a flow having a flow axis substantially parallel to the bit central axis, wherein the nozzle exit is located below a highest horizontal plane intersected by a cutting element, and wherein the nozzle orifice has a constant diameter for a length at least equal to the constant diameter.

32. A rotary cone bit as recited in claim 31 wherein the nozzle orifice has a constant diameter for a length at least equal to twice the constant diameter.

33. A rotary cone bit for drilling bore holes in earth formations comprising:

a bit body having a threaded pin end and a dome end;

three legs extending from the dome end of the body;

three cutter cones each having an apex opposite a mouth, wherein each cone is rotatably mounted through its mouth to each leg, wherein each cone is radially oriented about a bit body central axis wherein the apex of each cone is closer to the central axis than the cone mouth;

cutting elements extending from the cone outer surface comprising, at least one gage row proximate to the mouth, and at least one nose row proximate to the apex, the cutting elements being spaced away from the centerline of the bit body a sufficient distance to leave a cylindrical open space between the cutting elements; and a center jet having a converging nozzle having an exit orifice, wherein the nozzle is aligned to produce a flow having a flow axis substantially parallel to the bit central axis, wherein the nozzle exit is located below a highest horizontal plane intersected by a cutting element, and wherein cutting elements from at least two adjacent cones intermesh with each other.

34. A rotary cone bit as recited in claim 33 wherein at least one intermeshed cutting element has at least half of its length extending beyond the cone overlapped by a cutting element from an adjacent cone.

35. A rotary cone bit for drilling bore holes in earth formations comprising:

a bit body having a threaded pin end and a dome end;

three legs extending from the dome end of the body;

a cutter cone rotatably mounted on each leg, each cutter cone having at least a gage row of cutting elements and a nose row of cutting elements, wherein a portion of the cutting elements of one cone is at least partially intermeshed with a portion of the cutting elements of an adjacent cone, and wherein a cylindrical open space with a diameter of at least 0.3 inch is defined between the cutting elements of adjacent cones which is not intruded by a cutting element; and at least one jet, wherein the at least one jet includes a center jet located on the dome, the center jet having a nozzle having an orifice having an exit below a highest horizontal plane intersected by a cutting element for emitting fluid solely in the direction of the open space between the cones.

36. A rotary cone bit as recited in claim 35 wherein the emitted fluid has an axis coaxial with the bit central axis.

37. A rotary cone bit as recited in claim 35 wherein at least one cutting element has at least half of its length beyond the cone intermeshed with a cutting element from an adjacent cone.

38. A rotary cone bit as recited in claim 35 further comprising a jet sleeve secured to the dome, wherein the nozzle is replaceably connected to the sleeve and is located entirely below the dome.

39. A rotary cone bit as recited in claim 35 wherein the cylindrical space diameter is at least 0.35 inch for bits having a diameter up to and including 8¾ inches.

40. A rotary cone bit as recited in claim 39 wherein the cylindrical space diameter is at least 0.4 inch.

41. A rotary cone bit as recited in claim 35 wherein the cylindrical space diameter is at least 0.4 inch for bits having a diameter greater than 8¾ inches and up to and including 12¼ inches.

42. A rotary cone bit as recited in claim 41 wherein the cylindrical space diameter is at least 0.5 inch.

43. A rotary cone bit as recited in claim 35 wherein the cylindrical space diameter is at least 0.5 inch for bits having a diameter greater than 12¼ inches and up to and including 17½ inches.

44. A rotary cone bit as recited in claim 43 wherein the cylindrical space diameter is at least 0.75 inch.

45. A rotary cone bit as recited in claim 35 wherein the cylindrical space diameter is at least 0.6 inch for bits having a diameter greater than 17½ inches.

46. A rotary cone bit as recited in claim 45 wherein the cylindrical space diameter is at least 1 inch.

47. A rotary cone bit as recited in claim 35 wherein the cutting elements forming the nose row are located at a radial distance from the bit central axis equal to at least 5% of the bit gage diameter.

48. A rotary cone as recited in claim 35 wherein the fluid flow emitted from the nozzle forms a fluid flow column that is substantially contained within the cylindrical space.

49. A rotary cone bit as recited in claim 35 wherein the fluid flow column axis is directed to a location at the bottom of the bore hole within one third of half the bore hole diameter from the center of the bore hole.

50. A rotary cone bit as recited in claim 35 further comprising means separate from the center jet for emitting fluid flow, wherein at least 40% of all flow occurs through the center jet.

51. A rotary cone bit as recited in claim 35 wherein at least 75% of the total flow occurs through the center jet.

52. A rotary cone bit as recited in claim 35 wherein 100% of the flow occurs through the center jet.

53. A rotary cone bit as recited in claim 35 further comprising a protective shroud covering a portion of the nozzle extending below the dome end.

54. A rotary cone bit as recited in claim 35 wherein at least one cone has its surface near the cone apex proximate the nose row of cutting elements enhanced to increase the surface resistance to fluid erosion.

55. A rotary cone bit for drilling bore holes in earth formations comprising:

a bit body having a threaded pin end and a dome end;

three legs extending from the dome end of the body;

a cutter cone rotatable mounted on each leg, each cutter cone having at least a gage row of cutting elements and a nose row of cutting elements, wherein a portion of the cutting elements of one cone is at least partially intermeshed with a portion of the cutting elements of an adjacent cone, and wherein a cylindrical open space with a diameter of at least 0.3 inch is defined between the cutting elements of adjacent cones which is not intruded by a cutting element, the space having a central axis substantially parallel to the bit central axis; and a center jet located on the dome, the center jet having a nozzle having an orifice having an exit below a highest horizontal plane intersected by a cutting element for emitting fluid solely in the direction of the open space between the cones, wherein the nozzle orifice has a constant diameter for a length at least equal to the constant diameter.

56. A rotary cone bit as recited in claim 55 wherein the nozzle orifice has a constant diameter for a length at least equal to twice the constant diameter.

57. A rotary cone bit for drilling bore holes in earth formations comprising:

a bit body having a threaded pin end and a dome end;

three legs extending from the dome end of the body;

a cutter cone rotatably mounted on each leg;

a gage row of cutting elements on a cone;

a nose row of cutting elements on a cone;

a plurality of jets for emitting a fluid flow, wherein one of the plurality of jets is a center jet having a nozzle located near the center on the dome, the nozzle having an exit orifice located above a highest horizontal plane intersected by a nose row cutting element, and wherein at least 40% of the total fluid flow emitted is through the center jet.

58. A rotary cone bit as recited in claim 57 wherein at least 75% of the total flow is through the center jet.

59. A rotary cone bit as recited in claim 57 wherein the fluid flow from the center jet has an axis directed to a location at the bottom of the bore hole within one third of half the bore hole diameter from the center of the bore hole.

60. A rotary cone bit as recited in claim 57 wherein the nozzle exit orifice is located below a highest horizontal plane intersected by a cutting element.

61. A rotary cone bit as recited in claim 57 wherein at least one cone has its surface near the cone apex proximate the nose row of cutting elements enhanced to increase the surface resistance to fluid erosion.

62. A rotary cone bit as recited in claim 57 wherein the center jet comprises a plurality of exit orifices.

* * * * *

UNITED STATES PATENT AND TRADEMARK OFFICE

CERTIFICATE OF CORRECTION

PATENT NO. : 5,853,055
DATED : December 29, 1998
INVENTOR(S) : Cisneros et al.

It is certified that error appears in the above-identified patent and that said Letters Patent is hereby corrected as shown below:

Title page,
Item [75], correct the order of inventorship to read:
-- Dennis Cisneros, Kingwood, Tex.; Michael S. Oliver, Lafayette, La.; Alan W. Lockstedt, Tomball; Per I. Nese, Houston; Gary R. Portwood, Kingwood; Michael A. Siracki, The Woodlands, all of Tex. --

Signed and Sealed this

Eighth Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 5,853,055
DATED : December 29, 1998
INVENTOR(S) : Cisneros et al.

It is certified that error appears in the above-identified patent and that said Letters Patent is hereby corrected as shown below:

Title page,
Item [75], correct the order of inventorship to read:
-- Dennis Cisneros, Kingwood, Tex.; Michael S. Oliver, Lafayette, La.; Alan W. Lockstedt, Tomball; Per I. Nese, Houston; Gary R. Portwood, Kingwood; Michael A. Siracki, The Woodlands, all of Tex. --

Signed and Sealed this

Twenty-second Day of July, 2003

JAMES E. ROGAN
*Director of the United States Patent and Trademark Office*